US005890876A

United States Patent [19]

Suito et al.

[11] Patent Number: 5,890,876

[45] Date of Patent: Apr. 6, 1999

[54] CONTROL VALVE IN VARIABLE DISPLACEMENT COMPRESSOR

[75] Inventors: Ken Suito; Masahiro Kawaguchi; Hiroshi Kubo; Tomohiko Yokono, all of Kariya; Norio Uemura; Kazuaki Nagayoshi, both of Fujisawa; Ichiro Hirata, Sagamihara; Kouji Watanabe, Kamakura, all of Japan

[73] Assignees: Kabushiki Kaisha Toyoda Jidoshokki Seisakusho, Kariya; NOK Corporation, Minato-ku, both of Japan

[21] Appl. No.: 829,640

[22] Filed: Mar. 31, 1997

[30] Foreign Application Priority Data

Apr. 1, 1996 [JP] Japan ..... 8-078780

[51] Int. Cl.[6] ..... F04B 49/00

[52] U.S. Cl. ..... 417/213; 417/222.2; 137/907; 251/129.02; 251/61.5

[58] Field of Search ..... 417/213, 222.2; 137/907; 251/129.02, 61.5

[56] References Cited

U.S. PATENT DOCUMENTS

| | | | |
|---|---|---|---|
| 5,145,326 | 9/1992 | Kimura et al. | 417/222.2 |
| 5,681,150 | 10/1997 | Kawaguchi et al. | 417/222.2 |
| 5,702,235 | 12/1997 | Hirota et al. | 417/222.2 |

FOREIGN PATENT DOCUMENTS

| | | | |
|---|---|---|---|
| 0628722 | 12/1994 | European Pat. Off. | 417/222.2 |
| 3-023385 | 1/1991 | Japan | 417/222.2 |
| 6-026454 | 2/1994 | Japan | 417/222.2 |
| 6-34685 | 12/1994 | Japan | 417/222.2 |

*Primary Examiner*—Timothy Thorpe
*Assistant Examiner*—Cheryl J. Tyler
*Attorney, Agent, or Firm*—Brooks Haidt Haffner & Delahunty

[57] ABSTRACT

A control valve in a compressor that adjusts the discharge displacement based on controlling of an inclination of a cam plate. The compressor includes a supply passage for connecting a discharge chamber with a crank chamber. The control valve is placed midway on the supply passage for adjusting the amount of the gas introduced into the crank chamber from the discharge chamber. The control valve has a valve hole and a valve chamber respectively disposed midway on the supply passage. A valve body is located in the valve chamber to adjust the opening size of the valve hole. A reacting member reacts to the pressure in the first area. The reacting member moves the valve body via a first rod in accordance with the pressure in the first area. A solenoid is opposed to the reacting member with respect to the valve body. The solenoid has a fixed core, a plunger and a plunger chamber. Electric current sent to the solenoid produces a magnetic attractive force between the core and the plunger in accordance with a magnitude of the current. A second rod is placed between the plunger and the valve body to urge the valve body by the magnetic attractive force. The discharge chamber is connected with the valve chamber. The crank chamber is connected with the valve hole and the plunger chamber.

29 Claims, 7 Drawing Sheets

CONTROL VALVE IN VARIABLE DISPLACEMENT COMPRESSOR

BACKGROUND OF THE INVENTION

1. Field of the Invention

The present invention relates to a displacement control valve incorporated in variable displacement compressors that are used in vehicle air conditioners. More particularly, the present invention relates to a displacement control valve that controls the flow rate of refrigerant gas between discharge and crank chambers, and includes a mechanism for changing a set value of suction pressure at which the control valve is operable.

2. Description of the Related Art

A typical variable displacement compressor has a cam plate that is tiltably supported on a drive shaft. The inclination of the cam plate is controlled based on the difference between the pressure in a crank chamber and the pressure in cylinder bores. The stroke of each piston is varied by the inclination of the cam plate. Accordingly, the displacement of the compressor is varied and determined by the stroke of each piston. The compressor is provided with a discharge chamber and a crank chamber that are connected by a supply passage. A displacement control valve is located in the supply passage. The displacement control valve controls the flow rate of refrigerant gas from the discharge chamber to the crank chamber, thereby controlling the pressure in the crank chamber. Accordingly, the difference between the pressure in the crank chamber and the pressure in the cylinder bores is controlled by the control valve.

Japanese Unexamined Patent Publication No 3-23385, discloses such a displacement control valve used in a variable displacement compressor. As shown in FIG. 7, a control valve 101 includes a housing 102. A valve seat 103 is defined at the upper portion of the housing 102. A valve hole 104 is defined in the valve seat 103. A valve body 105 is provided on a rod 106 that extends through the valve hole 104. The valve body 105 is arranged in a high pressure chamber 109 facing the valve seat 103 to open and close the valve hole 104. The rod 106 connects the valve body 105 to a bellows 108, which is located in a low pressure chamber 107. Suction pressure Ps is introduced to the low pressure chamber 107. The bellows 108 expands and contracts in accordance with the suction pressure Ps. The high pressure chamber 109 is connected to a discharge pressure area in the compressor by a supply passage. Therefore, discharge pressure Pd is introduced to the high pressure chamber 109. An intermediate pressure chamber 110 is defined in the housing 102 between the high pressure chamber 109 and the low pressure chamber 107. The intermediate pressure chamber 110 is communicated with the high pressure chamber 109 by the valve hole 104 and is connected to the crank chamber by the supply passage.

A solenoid 111 is secured to the bottom of the housing 102. A fixed steel core 113 is provided at the upper portion of the solenoid 111. A steel plunger 112 is arranged in the solenoid 111 and moves along the axis of the plunger 112. A rod 112*a* is coupled to the plunger 112 and extends through the core 113. A coil 114 is wound about the plunger 112 and the fixed core 113. The top end of the rod 112*a* is adhered to the inner wall of the bellows 108. A spring 115 extends between the bottom end of the plunger 112 and the bottom of the solenoid 111. The spring 115 urges the plunger 112 upward. That is, the spring 115 urges the valve body 105 in a direction separating the valve body 105 from the valve seat 103 to open the valve hole 104.

An external control unit (not shown) sends electric current to the coil 114. The magnetic attractive force produced between the plunger 112 and the fixed core 113 is varied by the magnitude of the current from the external control unit. The magnitude of the force that pushes the plunger 112 upward, or the force for separating the valve body 105 from the valve seat 103, corresponds to the magnitude of the attraction force. When the solenoid 111 is excited, the higher suction pressure Ps contracts the bellows 108 and lowers the plunger 112. This causes the valve body 105 to close the valve hole 104. Contrarily, a lower suction pressure Ps expands the bellows 108 and lifts the valve body 105. This opens the valve hole 104. In this manner, the opening area between the valve body 105 and the valve hole 104 is adjusted in accordance with the suction pressure Ps. A magnitude of the suction pressure Ps required for lowering the valve body 105, that is for moving the valve body 105 toward the valve seat 103, is varied in accordance with the attraction force produced between the armature 112 and the retainer 113.

The above described prior art control valve 101 has the following disadvantages.

A compressor mounted on a vehicle is connected to an external refrigerant circuit that includes a condenser. If the vehicle is caught in a traffic jam in summer, the heat exchange capacity of the condenser is significantly lowered. In this case, the valve body 105 closes the valve hole 104, and the displacement of the compressor becomes maximum. The discharge pressure Pd thus becomes extremely high, and the pressure Pc in the crank chamber approaches the lower suction pressure Ps. The high discharge pressure Pd acts on the top surface of the valve body 105. The pressure in the intermediate pressure chamber 110, or the pressure Pc in the crank chamber, acts on the bottom surface of the valve body 105. The difference between the pressures Pd and Pc strongly presses the valve body 105 against the valve seat 103. This degrades the responsiveness of the valve body 105 with respect to the suction pressure Ps.

If the cooling load falls when the displacement of the compressor is maximum, the displacement of the compressor must be decreased. In order to decrease the compressor's displacement in such a state, the opening area between the valve body 105 and the valve hole 104 must be enlarged. The valve body 105 must thus be moved by a force that is greater than the difference between the discharge pressure Pd and the pressure Pc in the crank chamber. That is, the attraction force produced between the plunger 112 and the fixed core 113 must be increased for enlarging the opening area between the valve body 105 and the valve hole 104. This requires a larger solenoid 111. A large solenoid 111 consumes a relatively large amount of power, and thus increases the load on the alternator.

SUMMARY OF THE INVENTION

Accordingly, it is an objective of the present invention to provide a variable displacement compressor control valve that accurately controls the opening of a valve hole by a valve body.

Another objective of the present invention is to provide a variable displacement compressor control valve that has a compact solenoid.

To achieve the above objectives, the present invention discloses a control valve in a variable displacement compressor that adjusts the discharge displacement based on controlling of an inclination of a cam plate located in a crank chamber. The compressor includes a piston operably coupled to the cam plate and located in a cylinder bore. The piston compresses gas supplied to the cylinder bore from a first area and discharges the compressed gas to a second area. The inclination of the cam plate is variable based on the pressure in the crank chamber. The compressor includes a supply passage for connecting the second area with the crank chamber. The control valve is placed midway on the supply passage for adjusting the amount of the gas introduced into the crank chamber from the second area through the supply passage to control the pressure in the crank chamber. The control valve comprises a housing having a valve hole and a valve chamber respectively disposed midway on the supply passage. The valve hole has an opening and communicates with the valve chamber through the opening. A valve body faces the opening and is located in the valve chamber to adjust the opening size of the valve hole. The valve body is movable in a first direction and a second direction opposite to the first direction. The valve body moves in the first direction to open the valve hole. The valve body moves in the second direction to close the valve hole. A reacting member reacts to the pressure in the first area. A first rod is placed between the reacting member and the valve body. The reacting member moves the valve body in the second direction via the first rod in accordance with raising of the pressure in the first area. A solenoid is opposed to the reacting member with respect to the valve body. The solenoid has a fixed core, a plunger facing the core to move toward or away from the core, and a plunger chamber for accommodating the plunger. Electric current sent to the solenoid produces a magnetic attractive force between the core and the plunger in accordance with a magnitude of the current. A second rod is placed between the plunger and the valve body to urge the valve body in one of the first direction and the second direction by the magnetic attractive force. One of the second area and the crank chamber is connected with the valve chamber, the other is connected with the valve hole and the plunger chamber.

BRIEF DESCRIPTION OF THE DRAWINGS

The feature of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A variable displacement compressor control valve according to a first embodiment of the present invention will now be described with reference to FIGS. 1 to 5.

Figure 3:
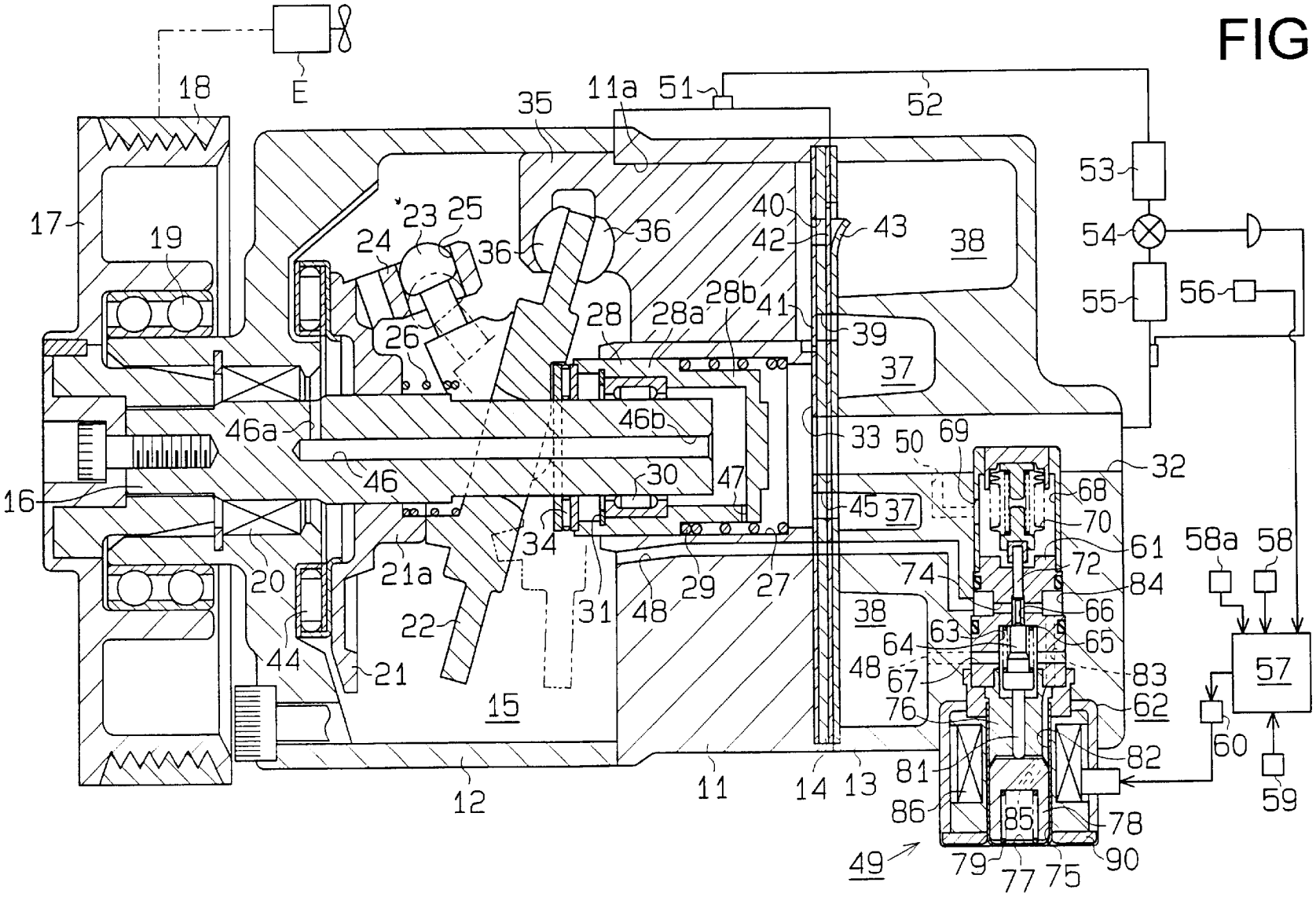
FIG. 3 is a cross-sectional view illustrating a variable displacement compressor including the control valve of FIG. 1.

Firstly, the structure of a variable displacement compressor will be described. As shown in FIG. 3, a front housing 12 is secured to the front end face of a cylinder block 11. A rear housing 13 is secured to the rear end face of the cylinder block 11 with a valve plate 14. A crank chamber 15 is defined by the inner walls of the front housing 12 and the front end face of the cylinder block 11.

A drive shaft 16 is rotatably supported in the front housing 12 and the cylinder block 11. The front end of the drive shaft 16 protrudes from the crank chamber 15 and is secured to a pulley 17. The pulley 17 is directly coupled to an external drive source (a vehicle engine E in this embodiment) by a belt 18. The compressor of this embodiment is a clutchless type variable displacement compressor having no clutch between the drive shaft 16 and the external drive source. The pulley 17 is supported by the front housing 12 with an angular bearing 19. The angular bearing 19 transfers thrust and radial loads that act on the pulley 17 to the housing 12.

A lip seal 20 is located between the drive shaft 16 and the front housing 12 for sealing the crank chamber 15.

A substantially disk-like swash plate 22 is supported by the drive shaft 16 in the crank chamber 15 to be slidable along and tiltable with respect to the axis of the shaft 16. The swash plate 22 is provided with a pair of guiding pins 23, each having a guide ball at the distal end. The guiding pins 23 are fixed to the swash plate 22. A rotor 21 is fixed to the drive shaft 16 in the crank chamber 15. The rotor 21 rotates integrally with the drive shaft 16. The rotor 21 has a support arm 24 protruding toward the swash plate 22. A pair of guide holes 25 are formed in the support arm 24. Each guide pin 23 is slidably fitted into the corresponding guide hole 25. The cooperation of the arm 24 and the guide pins 23 permits the swash plate 22 to rotate together with the drive shaft 16. The cooperation also guides the tilting of the swash plate 22 and the movement of the swash plate 22 along the axis of the drive shaft 16. As the swash plate 22 slides backward toward the cylinder block 11, the inclination of the swash plate 22 decreases.

A coil spring 26 is located between the rotor 21 and the swash plate 22. The spring 26 urges the swash plate 22 backward, or in a direction to decrease the inclination of the swash plate 22. The rotor 21 is provided with a projection 21*a* on its rear end face. The abutment of the swash plate 22 against the projection 21*a* prevents the inclination of the swash plate 22 beyond the predetermined maximum inclination.

Figure 4:
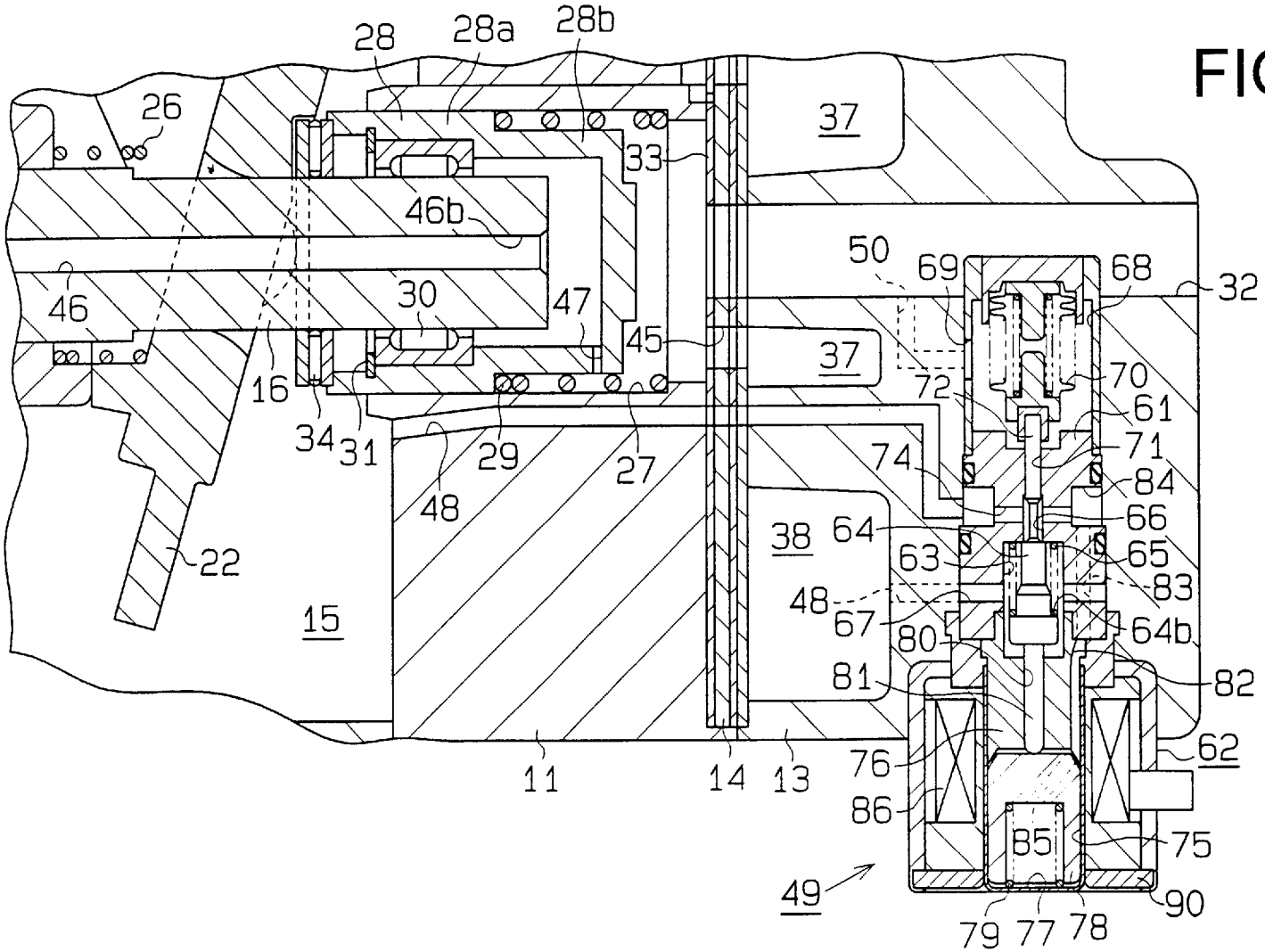
FIG. 4 is an enlarged partial cross-sectional view illustrating a compressor when the inclination of the swash plate is maximum.
Figure 5:
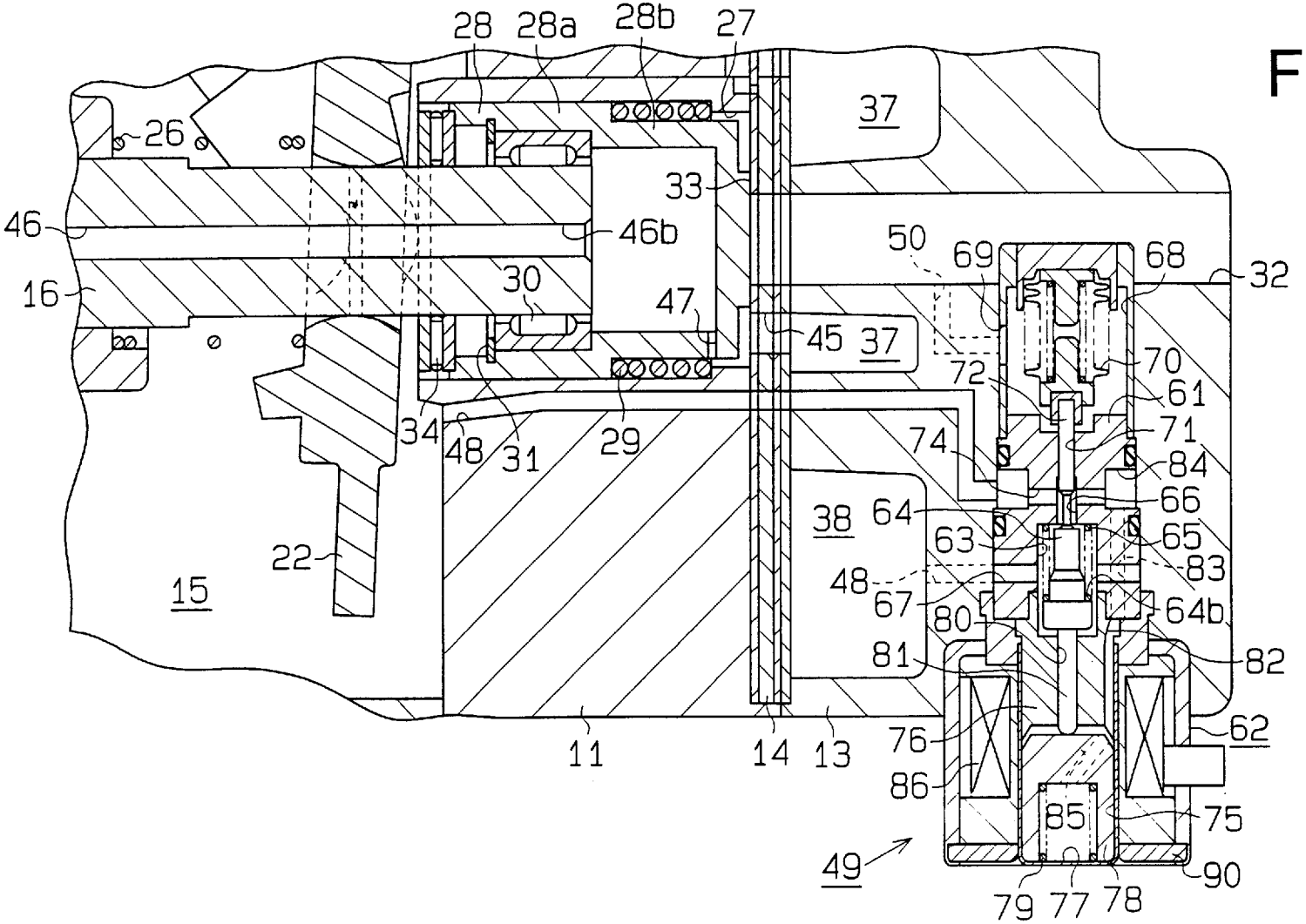
FIG. 5 is an enlarged partial cross-sectional view illustrating a compressor when the inclination of the swash plate is minimum.

As shown in FIGS. 3 to 5, a shutter chamber 27 is defined at the center portion of the cylinder block 11 extending along the axis of the drive shaft 16. A hollow cylindrical shutter 28 is accommodated in the shutter chamber 27. The shutter 28 slides along the axis of the drive shaft 16. The shutter 28 as a large diameter portion 28*a* and a small diameter portion 28*b*. A coil spring 29 is located between a step, which is defined by the large diameter portion 28*a* and the small diameter portion 28*b*, and a wall of the shutter chamber 27. The coil spring 29 urges the shutter 28 toward the swash plate 22.

The rear end of the drive shaft 16 is inserted in the shutter 28. The radial bearing 30 is fixed to the inner wall of the large diameter portion 28*a* of the shutter 28 by a snap ring 31. Therefore, the radial bearing 31 moves with the shutter 28 along the axis of the drive shaft 16. The rear end of the drive shaft 16 is supported by the inner wall of the shutter chamber 27 with the radial bearing 30 and the shutter 28 in between.

A suction passage 32 is defined at the center portion of the rear housing 13 and the valve plate 14. The passage 32 extends along the axis of the drive shaft 16 and is communicated with the shutter chamber 27. The suction passage 32 functions as a suction pressure area. A positioning surface 33 is formed on the valve plate 14 about the inner opening of the suction passage 32. The rear end of the shutter 28 abuts against the positioning surface 33. Abutment of the shutter 28 against the positioning surface 33 prevents the shutter 28 from further moving backward away from the rotor 21. The abutment also disconnects the suction passage 32 from the shutter chamber 27.

A thrust bearing 34 is supported on the drive shaft 16 and is located between the swash plate 22 and the shutter 28. The thrust bearing 34 slides along the axis of the drive shaft 16. The force of the coil spring 29 constantly retains the thrust bearing 34 between the swash plate 22 and the shutter 28. The thrust bearing 34 prevents the rotation of the swash plate 22 from being transmitted to the shutter 28.

The swash plate 22 moves backward as its inclination decreases. As it moves backward, the swash plate 22 pushes the shutter 28 backward through the thrust bearing 34. Accordingly, the shutter 28 moves toward the positioning surface 33 against the force of the coil spring 29. As shown in FIG. 5, when the swash plate 22 reaches the minimum inclination, the rear end of the shutter 28 abuts against the positioning surface 33. In this state, the shutter 28 is located at the closed position for disconnecting the shutter chamber 27 from the suction passage 32.

A plurality of cylinder bores 11*a* extend through the cylinder block 11 and are located about the axis of the drive shaft 16. The cylinder bores 11*a* are spaced apart at equal intervals. A single-headed piston 35 is accommodated in each cylinder bore 11*a*. A pair of semispherical shoes 36 are fitted between each piston 35 and the swash plate 22. A semispherical portion and a flat portion are defined on each shoe 36. The semispherical portion slidably contacts the piston 35 while the flat portion slidably contacts the swash plate 22. The swash plate 22 is rotated by the drive shaft 16 through the rotor 21. The rotating movement of the swash plate 22 is transmitted to each piston 35 through the shoes 36 and is converted to linear reciprocating movement of each piston 35 in the associated cylinder bore 11*a*.

An annular suction chamber 37 is defined in the rear housing 13. The suction chamber 37 is communicated with the shutter chamber 27 via a communication hole 45. An annular discharge chamber 38 is defined around the suction chamber 37 in the rear housing 13. Suction ports 39 and discharge ports 40 are formed in the valve plate 14. Each suction port 39 and each discharge port 40 correspond to one of the cylinder bores 11*a*. Suction valve flaps 41 are formed on the valve plate 14. Each suction valve flap 41 corresponds to one of the suction ports 39. Discharge valve flaps 42 are formed on the valve plate 14. Each discharge valve flap 42 corresponds to one of the discharge ports 40.

As each piston 35 moves from the top dead center to the bottom dead center in the associated cylinder bore 11*a*, refrigerant gas in the suction chamber 37 is drawn into each piston bore 11*a* through the associated suction port 39 while causing the associated suction valve flap 41 to flex to an open position. As each piston 35 moves from the bottom dead center to the top dead center in the associated cylinder bore 11*a*, refrigerant gas is compressed in the cylinder bore 11*a* and discharged to the discharge chamber 38 through the associated discharge port 40 while causing the associated discharge valve flap 42 to flex to an open position. Retainers 43 are formed on the valve plate 14. Each retainer 43 corresponds to one of the discharge valve flaps 42. The opening amount of each discharge valve flap 42 is defined by contact between the valve flap 42 and the associated retainer 43.

A thrust bearing 44 is located between the front housing 12 and the rotor 21. The thrust bearing 44 carries the reactive force of gas compression acting on the rotor 21 through the pistons 35 and the swash plate 22.

A pressure release passage 46 is defined at the center portion of the drive shaft 16. The pressure release passage 46 has an inlet 46*a*, which opens to the crank chamber 15 in the vicinity of the lip seal 20, and an outlet 46*b* that opens in the interior of the shutter 28. A pressure release hole 47 is formed in the peripheral wall near the rear end of the shutter 28. The hole 47 communicates the interior of the shutter 28 with the shutter chamber 27.

A supply passage 48 is defined in the rear housing 13, the valve plate 14 and the cylinder block 11. The supply passage 48 communicates the discharge chamber 38 with the crank chamber 15. A displacement control valve 49 is accommodated in the rear housing 13 midway in the supply passage 48. A pressure introduction passage 50 is defined in the rear housing 13. The passage 50 communicates the control valve 49 with the suction passage 32, thereby introducing suction pressure Ps into the control valve 49.

An outlet port 51 is defined in the cylinder block 11 and is communicated with the discharge chamber 38. The outlet port 51 is connected to the suction passage 32 by an external refrigerant circuit 52. The external refrigerant circuit 52 includes a condenser 53, an expansion valve 54 and an evaporator 55. A temperature sensor 56 is located in the vicinity of the evaporator 55. The temperature sensor 56 detects the temperature of the evaporator 55 and issues signals relating to the detected temperature to a control computer 57. The computer 57 is connected to various devices including a temperature adjuster 58, a compartment temperature sensor 58*a*, and an air conditioner starting switch 59. A passenger sets a desirable compartment temperature, or a target temperature, by the temperature adjuster 58.

The computer 57 inputs signals relating to a target temperature from the temperature adjuster 58, a detected evaporator temperature from the temperature sensor 56, and a detected compartment temperature from the temperature sensor 58*a*. Based on the inputted signals, the computer 57 commands the driving circuit 60 to send an electric current having a certain magnitude to the coil 86 of a solenoid 62, which will be described later, in the control valve 49. In addition to the above listed data, the computer 57 may use other data such as the temperature outside the compartment and the engine speed E for determining the magnitude of electric current sent to the control valve 49.

The structure of the control valve 49 will now be described.

Figure 1:
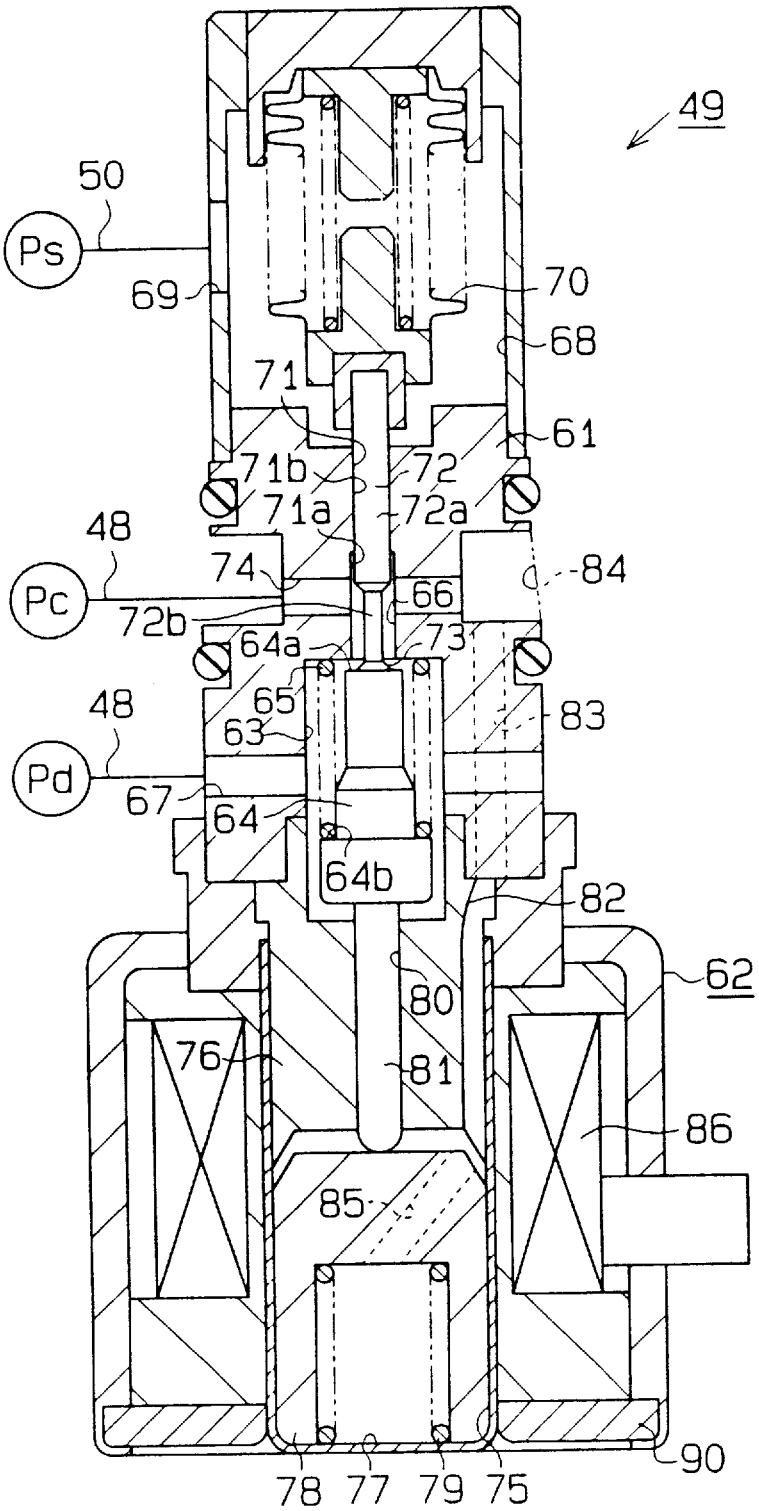
FIG. 1 is a cross-sectional view illustrating a control valve according to an embodiment of the present invention.
Figure 2:
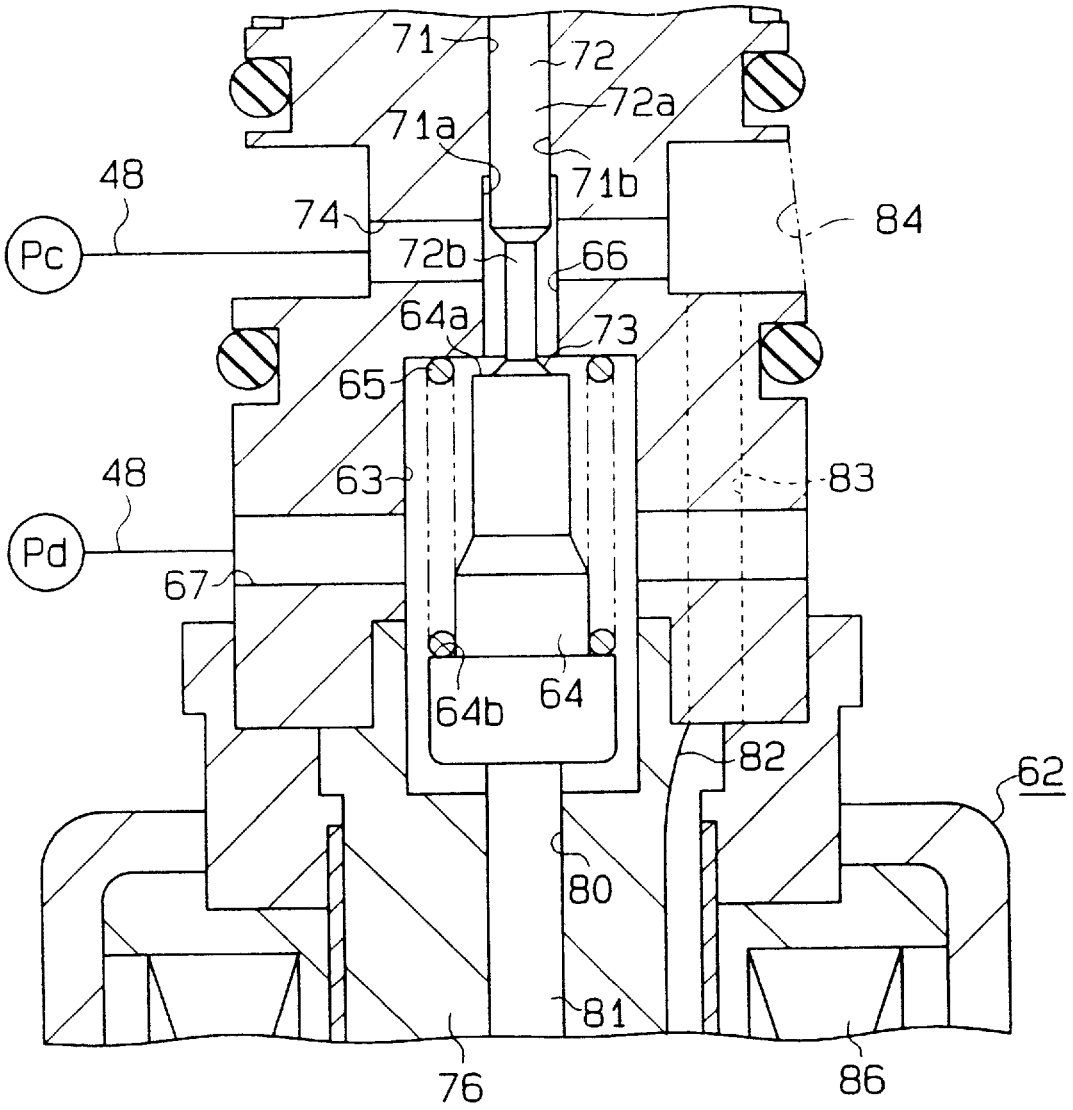
FIG. 2 is an enlarged partial cross-sectional view illustrating the control valve of FIG. 1.

As shown in FIGS. 1 to 3, the control valve 49 includes a housing 61 and the solenoid 62, which are secured to each other. A valve chamber 63 is defined between the housing 61 and the solenoid 62. The valve chamber 63 is connected to the discharge chamber 38 by a first port 67 and the supply passage 48. A valve body 64 is arranged in the valve chamber 63. A valve hole 66 is defined extending axially in the housing 61, and opens in the valve chamber 63. The area about the opening of the valve hole 66 functions as a valve seat, against which a top end 64*a* of the valve body 64 contacts. A first coil spring 65 extends between a step 64*b* defined on the valve body 64 and a wall of the valve chamber 63.

A pressure sensing chamber 68 is defined at the upper portion of the housing 61. The pressure sensing chamber 68 is provided with a bellows 70 and is connected to the suction passage 32 by a second port 69 and the pressure introduction passage 50. Suction pressure Ps in the suction passage 32 is thus introduced to the chamber 68 via the passage 50. The bellows 70 functions as a pressure sensing member for detecting the suction pressure Ps. A first guide hole 71 is defined in the housing 61 between the pressure sensing chamber 68 and the valve hole 66. The axis of the first guide hole 71 is aligned with the axis of the valve hole 66. The first guide hole 71 includes a large diameter portion 71*a* and a small diameter portion 71*b*. The portion 71*a* has a diameter that is substantially the same as the diameter of the valve hole 66, and it communicates with the hole 66. The portion 71*b* is slightly narrower than the portion 71*a*. The large diameter portion 71*a* is formed at the same time that the valve hole 66 is formed.

The bellows 70 is connected to the valve body 64 by a first rod 72 that is integrally formed with the valve body 64. The first rod 72 has a large diameter portion 72*a* and a small diameter portion 72*b*. The large diameter portion 72*a* extends through and slides with respect to the small diameter portion 71*b* of the first guide hole 71. The diameter of the portion 72*a* is smaller than the diameter of the valve hole 66 and is smaller than the diameter of the large diameter portion 71*a* of the first guide hole 71. In other words, the cross-sectional area of the portion 72*a* is smaller than the cross-sectional area of the valve hole 66. The small diameter portion 72*b* extends through the valve hole 66 between the large diameter portion 72*a* and the valve body 64. A clearance between the small diameter portion 72*b* and the valve hole 66 permits the flow of refrigerant gas. The small diameter portion 72*b* is connected to the top end 64*a* of the valve body 64 by a tapered portion 73. The diameter of the tapered portion 73 increases toward the valve body 64.

A third port 74 is defined in the housing 61 between the valve chamber 63 and the pressure sensing chamber 68. The port 74 extends perpendicularly with respect to the valve hole 66. The valve hole 66 is connected to the crank chamber 15 by the third port 74 and the supply passage 48.

An accommodating hole 75 is defined in the center portion of the solenoid 62. A fixed steel core 76 is fitted in the upper portion of the hole 75. A plunger chamber 77 is defined by the fixed core 76 and inner walls of the hole 75 at the lower portion of the hole 75 in the solenoid 62. A cylindrical plunger 78 is accommodated in the plunger chamber 77. The plunger 78 slides along the axis of the chamber 77. A second coil spring 79 extends between the plunger 78 and the bottom of the hole 75. The force of the second coil spring 79 is smaller than the force of the first coil spring 65. A second guide hole 80 is formed in the fixed core 76 between the plunger chamber 77 and the valve chamber 63. The axis of the second guide hole 80 is aligned with the axis of the first guide hole 71. A second rod 81 is formed integrally with the valve body 64 and projects downward from the bottom of the valve body 64. The second rod 81 is accommodated in and slides with respect to the second guide hole 80. The cross sectional area of the second rod 81 is substantially equal to the cross-sectional area of the valve hole 66. The first spring 64*b* urges the valve body 64 downward, while the second spring 79 urges the plunger 78 upward. This allows the lower end of the second rod 81 to constantly contact the plunger 78. In other words, the valve body 64 moves integrally with the plunger 78 with the second rod 81 in between.

A small chamber 84 is defined by the inner wall of the rear housing 13 and the circumference of the valve 49 at a position corresponding to the third port 74. The small chamber 84 is connected to the valve hole 66 by the third port 74. A communication groove 82 is formed in a side of the fixed core 76, and opens in the plunger chamber 77. A communication passage 83 is formed in the middle portion of the housing 61 for communicating the groove 82 with the small chamber 84. Accordingly, the plunger chamber 77 is connected to the valve hole 66 by the groove 82, the small chamber 84, and the third port 74. This equalizes the pressure in the plunger chamber 77 with the pressure in the valve hole 66 (pressure Pc in the crank chamber 15). The plunger 78 is provided with a through hole 85 that communicates the upper portion of the plunger chamber 77 with the lower portion of the chamber 77.

A cylindrical coil 86 is wound around the fixed core 76 and the plunger 78. The driving circuit 60 provides the coil 86 with electric current based on commands from the computer 57. The computer 57 determines the magnitude of the current provided to the coil 86. A plate 90 made of magnetic material is accommodated in the bottom portion of the solenoid 62.

The operation of the above described compressor will now be described.

When the air conditioner starting switch 59 is on, if the temperature detected by the compartment temperature sensor 58*a* is higher than a target temperature set by the temperature adjuster 58, the computer 57 commands the driving circuit 60 to excite the solenoid 62. Accordingly, electric current having a certain magnitude is sent to the coil 86 from the driving circuit 60. This produces a magnetic attractive force between the fixed core 76 and the plunger 78, as illustrated in FIGS. 3 and 4, in accordance with the current magnitude. The attractive force is transmitted to the valve body 64 by the second rod 81, and thus urges the valve body 64 against the force of the first spring 65 in a direction closing the valve hole 66. On the other hand, the length of the bellows 70 changes in accordance with the suction pressure Ps in the suction passage 32 that is introduced to the pressure sensing chamber 68 via the pressure introduction passage 50. The changes in the length of the bellows 70 is transmitted to the valve body 64 by the first rod 72. The higher the suction pressure Ps is, the shorter the bellows 70 becomes. As the bellows 70 becomes shorter, the bellows 70 pulls the valve body 64 in a direction closing the valve hole 66.

The opening area between the valve body 64 and the valve hole 66 is determined by the equilibrium of a plurality of forces acting on the valve body 64. Specifically, the opening area is determined by the equilibrium position of the body 64, which is affected by the force of the solenoid 62 that acts on the valve body 64 through the second rod 81, the force of the bellows 70 acting on the valve body 64 through the first rod 72, and the force of the first spring 65.

Suppose the cooling load is great, the suction pressure Ps is high and the temperature in the vehicle compartment detected by the sensor 58*a* is significantly higher than a target temperature set by the temperature adjuster 58. The computer 57 commands the driving circuit 60 to send a current having a greater magnitude to the coil 86 of the control valve 49 for a greater difference between the detected temperature and the target temperature. In other words, the computer 57 increases the magnitude of the current sent to the coil 86 as the difference between the compartment temperature and the target temperature increases. This increases the attractive force between the fixed core 76 and the plunger 78, thereby increasing the resultant force that causes the valve body 64 to close the valve hole 66. This lowers the pressure Ps required for moving the valve body 64 in a direction closing the valve hole 66. In other words, as the magnitude of the current to the control valve 49 is increased, the valve 49 functions such that the pressure Ps required to close the valve 49 is decreased to a lower level.

A smaller opening area between the valve body 64 and the valve hole 66 decreases the amount of refrigerant gas flow from the discharge chamber 38 to the crank chamber 15 via the supply passage 48. The refrigerant gas in the crank chamber 15 flows into the suction chamber 37 via the pressure release passage 46 and the pressure release hole 47. This lowers the pressure Pc in the crank chamber 15.

Further, when the cooling load is great, the suction pressure Ps is high. Accordingly, the pressure in each cylinder bore 11*a* is high. Therefore, the difference between the pressure Pc in the crank chamber 15 and the pressure in each cylinder 11*a* is small. This increases the inclination of the swash plate 22, thereby allowing the compressor to operate at a large displacement.

When the valve hole 66 in the control valve 49 is completely closed by the valve body 64, the supply passage 48 is closed. This stops the supply of the highly pressurized refrigerant gas in the discharge chamber 38 to the crank chamber 15. Therefore, the pressure Pc in the crank chamber 15 becomes substantially the same as a low pressure Ps in the suction chamber 37. The inclination of the swash plate 22 thus becomes maximum as shown in FIGS. 3 and 4, and the compressor operates at the maximum displacement. The abutment of the swash plate 22 and the projection 21*a* of the rotor 21 prevents the swash plate 22 from inclining beyond the predetermined maximum inclination.

Suppose the cooling load is small, the suction pressure Ps is low, and the difference between the compartment temperature detected by the sensor 58*a* and the target temperature set by the temperature adjuster 58 is small. In this state, the computer 57 commands the driving circuit 60 to send a current having a smaller magnitude to the coil 86 of the control valve 49. In other words, the computer 57 decreases the magnitude of the current sent to the coil 86 as the difference between the compartment temperature and the target temperature becomes smaller. This decreases the attractive force between the fixed core 76 and the plunger 78, thereby decreasing the resultant force that moves the valve body 64 in a direction closing the valve hole 66. This raises the pressure Ps required for moving the valve body 64 in a direction closing the valve hole 66. In other words, as the magnitude of the current to the control valve 49 is decreased, the valve 49 functions such that the pressure Ps required to close the valve 49 is increased to a higher level.

A larger opening area between the valve body 64 and the valve hole 66 increases the amount of refrigerant gas flow from the discharge chamber 38 to the crank chamber 15. This increases the pressure Pc in the crank chamber 15. Further, when the cooling load is small, the suction pressure Ps is low and the pressure in each cylinder bores 11*a* is low. Therefore, the difference between the pressure Pc in the crank chamber 15 and the pressure in each cylinder 11*a* is great. This decreases the inclination of the swash plate 22. The compressor thus operates at a small displacement.

As cooling load approaches zero, the temperature of the evaporator 55 in the external refrigerant circuit 52 drops to a frost forming temperature. When the temperature sensor 56 detects a temperature that is lower than the frost forming temperature, the computer 57 commands the driving circuit 60 to de-excite the solenoid 62. The driving circuit 60 stops sending current to the coil 86, accordingly. This eliminates the magnetic attractive force between the fixed core 76 and the plunger 78. The valve body 64 is then moved by the force of the first spring 65 against the weaker force of the second spring 79, which is transmitted by the plunger 78 and the second rod 81. In other words, the valve body 64 is moved in a direction opening the valve hole 66. This maximizes the opening area between the valve body 64 and the valve hole 66. Accordingly, the gas flow from the discharge chamber 38 to the crank chamber 15 is increased. This further raises the pressure Pc in the crank chamber 15, thereby minimizing the inclination of the swash plate 22. The compressor thus operates at the minimum displacement.

When the switch 59 is turned off, the computer 57 commands the driving circuit 60 to de-excite the solenoid 62. This also minimizes the inclination of the swash plate 22.

As described above, when the magnitude of the current to the coil 86 is increased, the valve body 64 functions such that the opening area of the valve hole 66 is closed by a lower suction pressure Ps. When the magnitude of the current to the coil 86 is decreased, on the other hand, the valve body 64 functions such that the opening area of the valve hole 66 is closed by a higher suction pressure Ps. In other words, a greater magnitude of current provided to the coil 86 sets the value of suction pressure Ps for closing the opening area of the valve hole 66 to a lower level. Contrarily, a smaller magnitude of current provided to the coil 86 sets the value of suction pressure Ps required for closing the opening area of the valve hole 66 to a higher level. The compressor controls the inclination of the swash plate 22 to adjust the displacement, thereby maintaining the valve shutting value of the suction pressure Ps.

Accordingly, the functions of the control valve 49 include changing the valve shutting value of the suction pressure Ps in accordance with the magnitude of the supplied current and allowing the compressor to operate at the minimum displacement at any given suction pressure Ps. A compressor equipped with the control valve 49 having such functions varies the cooling ability of the air conditioner.

The shutter 28 slides in accordance with the tilting motion of the swash plate 22. As the inclination of the swash plate 22 decreases, the shutter 28 gradually reduces the cross-sectional area of the passage between the suction passage 32 and the suction chamber 37. This gradually reduces the amount of refrigerant gas that enters the suction chamber 37 from the suction passage 32. The amount of refrigerant gas that is drawn into the cylinder bores 11*a* from the suction chamber 37 gradually decreases, accordingly. As a result, the displacement of the compressor gradually decreases. This gradually lowers the discharge pressure Pd of the compressor. The load torque of the compressor gradually decreases, accordingly. In this manner, the load torque for operating the compressor does not change dramatically in a short time when the displacement decreases from the maximum to the minimum. The shock that accompanies load torque fluctuations is therefore lessened.

When the inclination of the swash plate 22 is minimum, the shutter 28 abuts against the positioning surface 33. The abutment of the shutter 28 against the positioning surface 33 prevents the inclination of the swash plate 22 from being smaller than the predetermined minimum inclination. The abutment also disconnects the suction passage 32 from the suction chamber 37. This stops the gas flow from the external refrigerant circuit 52 to the suction chamber 37, thereby stopping the circulation of refrigerant gas between the circuit 52 and the compressor.

The minimum inclination of the swash plate 22 is slightly larger than zero degrees. Zero degrees refers to the angle of the swash plate's inclination when it is perpendicular to the axis of the drive shaft 16. Therefore, even if the inclination of the swash plate 22 is minimum, refrigerant gas in the cylinder bores 11*a* is discharged to the discharge chamber 38 and the compressor operates at the minimum displacement. The refrigerant gas discharged to the discharge chamber 38 from the cylinder bores 11*a* is drawn into the crank chamber 15 through the supply passage 48. The refrigerant gas in the crank chamber 15 is drawn back into the cylinder bores 11*a* through the pressure release passage 48, a pressure release hole 47 and the suction chamber 37. That is, when the inclination of the swash plate 22 is minimum, refrigerant gas circulates within the compressor traveling through the discharge chamber 38, the supply passage 48, the crank chamber 15, the pressure release passage 46, the pressure release hole 47, the suction chamber 37 and the cylinder bores 11*a*. This circulation of refrigerant gas allows the lubricant oil contained in the gas to lubricate the moving parts of the compressor.

If the switch 59 is on and the inclination of the swash plate 22 is minimum, an increase in the compartment temperature increases the cooling load. In this case, the temperature detected by the compartment temperature sensor 58*a* is higher than a target temperature set by the compartment temperature adjuster 58. The computer 57 commands the driving circuit 60 to excite the solenoid 62 based on the detected temperature increase. When the solenoid 62 is excited, the supply passage 48 is closed. This stops the flow of refrigerant gas from the discharge chamber 38 into the crank chamber 15. The refrigerant gas in the crank chamber 15 flows into the suction chamber 37 via the pressure release passage 46 and the pressure release hole 47. This gradually lowers the pressure Pc in the crank chamber 15, thereby moving the swash plate 22 from the minimum inclination to the maximum inclination.

As the swash plate's inclination increases, the force of the spring 29 gradually pushes the shutter 28 away from the positioning surface 33. This gradually enlarges the cross-sectional area of gas flow from the suction passage 32 to the suction chamber 37. Accordingly, the amount of refrigerant gas flow from the suction passage 32 into the suction chamber 37 gradually increases. Therefore, the amount of refrigerant gas that is drawn into the cylinder bores 11*a* from the suction chamber 37 gradually increases. The displacement of the compressor gradually increases, accordingly. The discharge pressure Pd of the compressor gradually increases and the torque necessary for operating the compressor also gradually increases. In this manner, the torque of the compressor does not dramatically change in a short time when the compressor's displacement changes from the minimum to the maximum. The shock that accompanies load torque fluctuations is thus lessened.

If the engine E is stopped, the compressor is also stopped (that is, the rotation of the swash plate 22 is stopped) and the supply of current to the coil 86 in the control valve 49 is stopped. This de-excites the solenoid 62, thereby opening the supply passage 48. In this state, the inclination of the swash plate 23 is minimum. If the nonoperational state of the compressor continues, the pressures in the chambers of the compressor become equalized and the swash plate 22 is kept at the minimum inclination by the force of spring 26. Therefore, when the engine E is started again, the compressor starts operating with the swash plate at the minimum inclination. This requires the minimum torque. The shock caused by starting the compressor is thus reduced.

The first and second rods 72, 81 are formed at the ends of the valve body 64. The first rod 72 is connected to the bellows 70, and the second rod 81 is connected to the solenoid 62. The cross-sectional area of the second rod 81 is substantially equal to the cross-sectional area of the valve hole 66, which faces the valve body 64. The valve chamber 63 is defined in the valve 49 for accommodating the valve body 64. The pressure Pd in the discharge chamber 38 is introduced to the chamber 63 via the supply passage 48 and the first port 67. When the valve body 64 closes the valve hole 66, the discharge pressure Pd acts on the valve body 64 except for the part to which the second rod 81 is connected and the part that faces the valve hole 66. Therefore, when the valve body 63 closes the valve hole 66, a force based on discharge pressure Pd that moves the valve body 64 in a direction closing the valve body 66 is equal to a force based on discharge pressure Pd that moves the valve body in a direction opening the valve hole 66. Accordingly, the forces of the discharge pressure Pd acting on the valve body 64 cancel each other out.

The pressure Pc in the crank chamber 15 is introduced to the valve hole 66 via the supply passage 48 and the third port 74. The pressure Pc in the valve hole 66 is then introduced to the plunger chamber 77 via the small chamber 84, the communication passage 83 and the communication groove 82. This equalizes the pressure in the plunger chamber 77 with the pressure in the valve hole 66.

The cross-sectional area of the first rod's large diameter portion 72*a* is smaller than the cross-sectional area of the valve hole 66. Therefore, when the valve body 64 closes the valve hole 66, the pressure Pc in the valve hole 66 urges the valve body 64 in a direction opening the valve hole 66 by a force based on the difference between the cross-sectional area of the large diameter portion 72*a* and the cross-sectional area of the valve hole 66. On the other hand, the pressure Pc in the plunger chamber 77 acts on the distal end of the second rod 81 that has substantially the same cross-sectional area as the valve hole 66. This urges the valve body 64 in a direction closing the valve hole 66. Therefore, small cross-sectional area of the portion 72*a* represents the small difference between a force based on the pressure Pc that urges the valve body 64 in a direction closing the hole 66 and a force based on the pressure Pc that urges the valve body 64 in a direction opening the hole 66. Accordingly, the forces based on the crank chamber pressure Pc acting on the valve body 64 nearly cancel each other. That is, the cross-sectional area of the portion 72*a* is made as small as possible to decrease the difference between the opposing forces.

As described above, the control valve 49 according to this embodiment minimizes the forces based on the discharge pressure Pd and the crank chamber pressure Pc acting on the valve body 64. Therefore, the valve body 64 is not pressed hard against the valve hole 66 by the discharge pressure Pd or the crank chamber pressure Pc. Thus, the opening area of the valve hole 66 is accurately controlled by the valve body 64. Further, even if the discharge pressure Pd is high, the valve body 64 is moved to open the valve hole 66 without increasing the attractive force between the fixed core 76 and the plunger 78. This enables the size of the solenoid 62 and the power consumption of the compressor to be reduced. The control valve 49 is suitable for a clutchless type variable displacement compressor that is directly connected to an external driving force E.

The low suction pressure Ps is introduced to the pressure sensing chamber 68 via the pressure introduction chamber 50. The high discharge pressure Pd is introduced to the valve chamber 63 via the supply passage 48. The valve hole 66 is defined between the pressure sensing chamber 68 and the valve chamber 63. The pressure Pc in the crank chamber 15 is introduced to the valve hole 66 via the third port 74 defined between the pressure sensing chamber 68 and the valve chamber 63. The crank chamber pressure Pc fluctuates between the suction pressure Ps and the discharge chamber Pd. In other words, the intermediate pressure area (valve hole 66) is located between the low pressure area (pressure sensing chamber 68) and the high pressure area (valve chamber 63). This structure reduces the leakage of highly pressurized refrigerant gas into the pressure sensing chamber 68 through the clearance between the first rod 72 and the first guide hole 71. Accordingly, the pressure in the pressure sensing chamber 68 is suppressed to a level that is no higher than needed. Therefore, the opening area of the valve hole 66 is not reduced below the necessary level, and the displacement of the compressor is accurately controlled. The highly pressurized refrigerant gas that leaks into the pressure sensing chamber 68 (low pressure area) expands in the chamber 68. However, the leakage of the highly pressurized refrigerant gas into the chamber 68 is reduced in this embodiment. Accordingly, the amount of highly pressurized gas that expands in the chamber 68 is reduced. This improves the compression efficiency of the compressor.

If the valve body 64 and the second rod 81 are two separate parts, highly pressurized refrigerant gas in the valve chamber 63 may enter between the valve body 64 and the rod 81. This separates the valve body 64 from the second rod 81, thereby disturbing the balance of forces acting on the valve body 64. However, the second rod 81 is integrally formed with the valve body 64 in this embodiment. This prevents the highly pressurized gas in the valve chamber 63 from entering between the valve body 64 and the second rod 81. This stabilizes the balance of the forces acting on the valve body 64. Therefore, the forces based on the discharge pressure Pd acting on the valve body 64 are canceled.

In addition to the second rod 81, the first rod 72 is integrally formed with the valve body 64. This reduces the number of parts, thereby facilitating assembly of the control valve 49. Also, when manufacturing, the first and second rods 72, 81 and the valve body 64 are accurately arranged on the same axis. This allows the valve body 64 to positively close the valve hole 66 and improves the seal between the valve body 64 and the valve hole 66. This construction also permits lubrication of the valve body 64.

The top end 64*a* of the valve body 64 is formed flat. Therefore, even if the axes of the valve body 64 and the rods 72, 81 are not aligned, the valve body 64 closes the valve hole 66.

The tapered portion 73 is formed on the top end 64*a* of the valve body 64. The tapered portion 73 continuously changes the cross-sectional area of the gas flow from the valve chamber 63 to the valve hole 66 when the valve hole 66 is being closed or opened by the valve body 64. This prevents highly pressurized gas from being abruptly supplied or stopped to the crank chamber 15. This stabilizes the displacement control of the compressor.

The first spring 65 extends between the step 64*b* on the valve body 64 and the inner wall of the valve chamber 63 for urging the valve body 64 in a direction opening the valve hole 66. When the solenoid 63 is de-excited, the spring 65 causes the valve body 64 to fully open the valve hole 66. Therefore, with the solenoid 62 de-excited, the compressor is in the minimum displacement state. The control valve 49 according to this embodiment is thus suitable for a clutchless type variable displacement compressor, which keeps operating at the minimum displacement when there is no cooling load.

The first guide hole 71 has a smaller diameter than the valve hole 66. The large diameter portion 72*a* of the first rod 72 is slidably accommodated in the small diameter portion 71*b* of the first guide hole 71. The large diameter portion 71*a* of the first guide hole 71 is connected to the valve hole 66 and has substantially the same diameter as the valve hole 66. That is, the large diameter portion 71*a* of the first guide hole 71 has a larger diameter than the large diameter portion 72*a* of the first rod 72. This defines a clearance between the portion 72*a* and the portion 71*a*. The refrigerant gas that flows from the discharge chamber 38 to the valve hole 66 via the valve chamber 63 contains lubricant oil. The lubricant oil stays in the clearance between the portions 72*a* and 71*a*, and enters between the large diameter portion 72*a* of the first rod 72 and the small diameter portion 71*b* of the first guide hole 71. The lubricant oil lubricates the motion of the first rod 72 with respect to the first guide hole 71. Changes in the length of the bellows 70 are thus accurately transmitted to the valve body 64. Further, the lubricant oil between the large diameter portion 72*a* of the first rod 72 and the small diameter portion 71*b* of the guide hole 71 restricts gas leakage from the valve hole 66 to the pressure sensing chamber 68.

Since the large diameter portion 71*a* of the first guide hole 71 has the same diameter as the valve hole 66, the portion 71*a* may be formed simultaneously with the valve hole 66. This facilitates the forming of the large diameter portion 71*a*.

Figure 6:
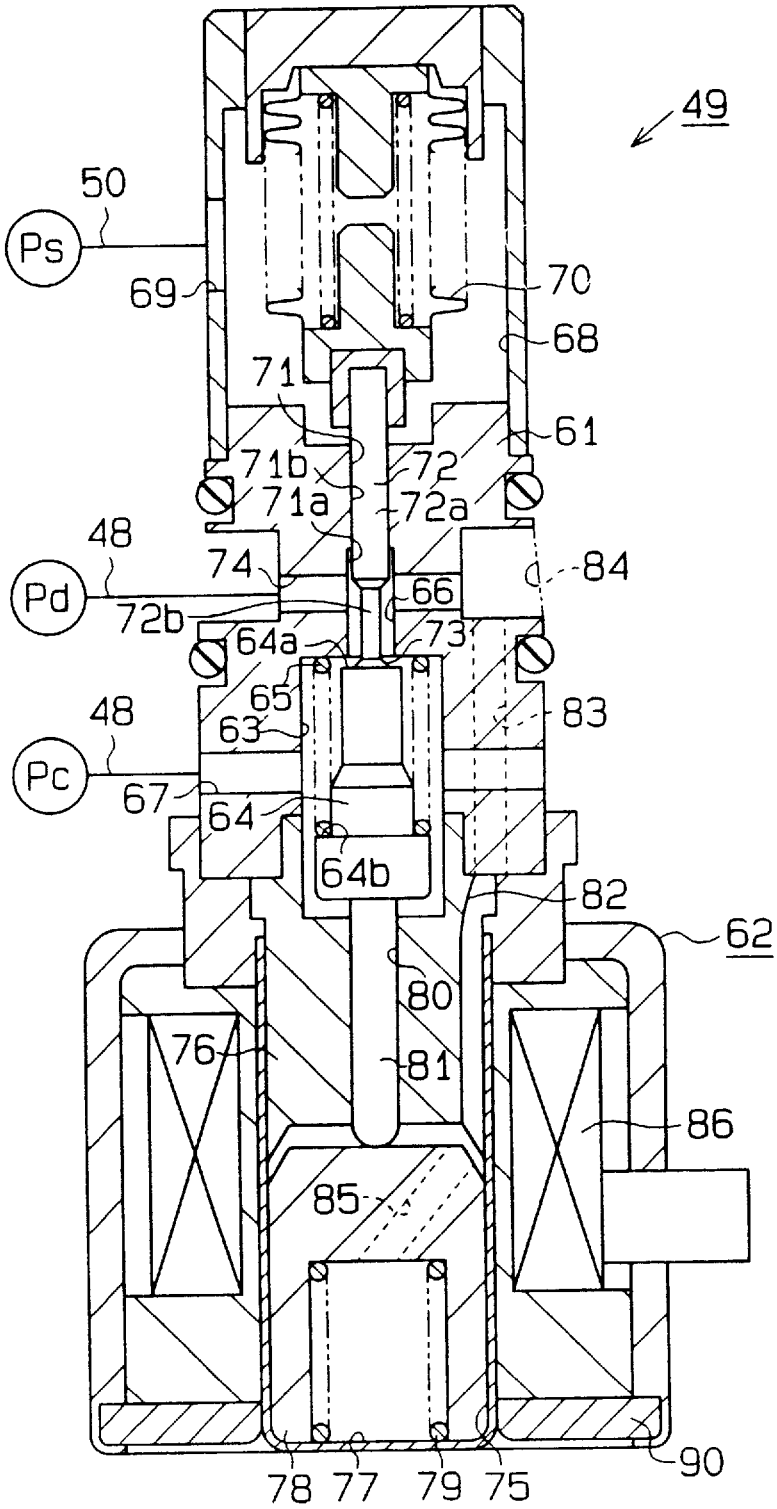
FIG. 6 is a cross-sectional view illustrating a control valve according to another embodiment of the present invention.
Figure 7:
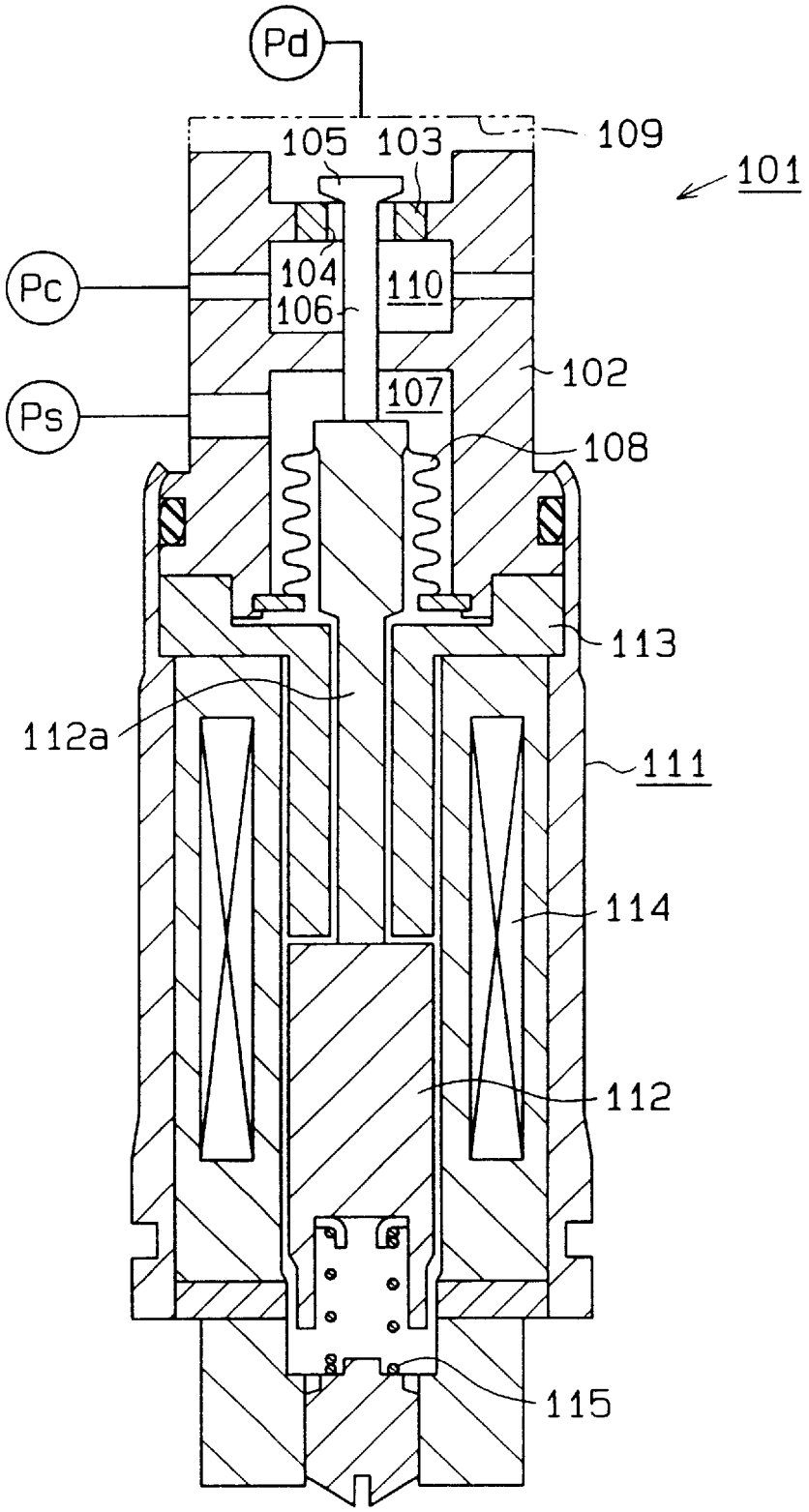
Fig.7 (Prior Art)
FIG. 7 is a cross-sectional view illustrating a prior art control valve.

The present invention may be alternatively embodied in the following forms:

(1) In the embodiment of FIG. 6, the third port 74 is connected to the discharge chamber 38 by the supply passage 48, and the first port 67 is connected to the crank chamber 15 by the supply passage 48. The discharge pressure Pd is introduced to the valve hole 66 and the plunger chamber 77, and the crank chamber pressure Pc is introduced to the valve chamber 63. This structure also cancels or nearly cancels forces based on the discharge pressure Pd and the crank chamber pressure Pc acting on the valve body 64.

(2) The tapered portion 73 on the top end 64*a* of the valve body 64 may be omitted. The top end 64*a* of the valve body 64 is thus formed flat except for the part to which the first rod 72 is coupled. This structure allows the valve body 64 to close the valve hole 66 even if the axes of the rods 72, 81 are misaligned with the axis of the valve body 64. The allowed misalignment of the axes is larger than the case where the tapered portion 73 is formed on the top end 64*a* of the valve body 64.

(3) Instead of the tapered portion 73, a semispherical portion may be formed on the top end 64*a* of the valve body 64. This structure results in smoother changes in cross-sectional area of the gas flow from the valve chamber 63 to the valve hole 66 when the valve body 64 is opening or closing the valve hole 66. This further stabilizes the displacement control of the compressor.

(4) Instead of the tapered portion 73, a plurality of steps may be formed on the top end 64*a* of the valve body 64. When the valve body 64 is opening or closing the valve hole 66, this structure allows the cross-sectional area of the gas flow from the valve chamber 63 to the valve hole 66 to be changed in a step-by-step manner. This is effective to stabilize the displacement control of the compressor.

(5) A passage for introducing the pressure Pc in the crank chamber 15 may be formed separately from the supply passage 48.

(6) The control valve 49 according to the present invention may be employed in a clutch type variable displacement compressor.

(7) The first rod 72 and the valve body 64 may be separately manufactured.

(8) The second spring 79 between the plunger 78 and the bottom of the accommodating hole 75 may be omitted.

(9) In stead of the through hole 85, a groove may be formed in the surface of the plunger 78 for communicating the upper portion of the plunger chamber 77 with the lower portion of the chamber 77.

(10) The cross-sectional area of the second rod 81 may be slightly different from the cross-sectional area of the valve hole 66. Changing the difference between the cross-sectional areas of the rod 81 and the hole 66 varies the operational characteristics of the control valve 49.

(11) The cross-sectional area of the first rod's large diameter portion 72*a* may be the same as or larger than the cross-sectional area of the valve hole 66.

Therefore, the present examples and embodiments are to be considered as illustrative and not restrictive and the invention is not to be limited to the details given herein but may be modified within the scope of the appended claims.

What is claimed is:

1. A control valve in a variable displacement compressor that adjusts the discharge displacement based on controlling of an inclination of a cam plate located in a crank chamber, wherein said compressor includes a piston operably coupled to the cam plate and located in a cylinder bore, said piston compressing gas supplied to the cylinder bore from a first area and discharging the compressed gas to a second area, the inclination of the cam plate being variable based on the pressure in the crank chamber, and a supply passage for connecting the second area with the crank chamber, wherein said control valve is placed midway on the supply passage for adjusting the amount of the gas introduced into the crank chamber from the second area through the supply passage to control the pressure in the crank chamber, said control valve comprising:

a housing having a valve hole and a valve chamber respectively disposed midway on the supply passage, wherein said valve hole has an opening and communicates with the valve chamber through the opening;

a valve body facing the opening and located in the valve chamber to adjust the opening size of the valve hole, said valve body being movable in a first direction and a second direction opposite to the first direction, wherein said valve body moves in the first direction to open the valve hole, and wherein said valve body moves in the second direction to close the valve hole;

a reacting member reacting to the pressure in the first area;

a first rod placed between the reacting member and the valve body, wherein said reacting member moves the valve body in the second direction via the first rod in accordance with raising of the pressure in the first area;

a solenoid opposed to the reacting member with respect to the valve body, said solenoid having a fixed core, a plunger facing the core to move toward or away from the core, and a plunger chamber for accommodating the plunger, wherein electric current sent to the solenoid produces a magnetic attractive force between the core and the plunger in accordance with a magnitude of the current;

a second rod placed between the plunger and the valve body to urge the valve body in one of the first direction and the second direction by the magnetic attractive force; and one of the second area and the crank chamber being connected with the valve chamber, the other being connected with the valve hole and the plunger chamber.

2. The control valve according to claim 1, wherein said housing has a pressure chamber connected with the first area, wherein said reacting member is located in the pressure chamber, and wherein said valve hole is defined between the valve chamber and the pressure chamber.

3. The control valve according to claim 2, wherein said housing has a guide hole defined between the pressure chamber and the valve hole to support the first rod in a slidable manner in an axial direction of the first rod, wherein said first rod extends through the guide hole and the valve hole.

4. The control valve according to claim 3, wherein said guide hole has an opening portion and communicates with the valve hole through the opening portion, wherein said opening portion has a diameter larger than that of said first rod.

5. The control valve according to claim 4, wherein the axis of said guide hole is aligned with the axis of the valve hole, and wherein said diameter of said opening portion is substantially equal to the diameter of said valve hole.

6. The control valve according to claim 1, wherein said valve chamber is connected with the second area, and wherein said valve hole and said plunger chamber are connected with the crank chamber.

7. The control valve according to claim 1, wherein said valve chamber is connected with the crank chamber, and wherein said valve hole and said plunger chamber are connected with the second area.

8. The control valve according to claim 1 further comprising a passage for connecting the plunger chamber with the valve hole.

9. The control valve according to claim 1, wherein said second rod has a cross-sectional area that is substantially equal to the cross-sectional area of said valve hole.

10. The control valve according to claim 3, wherein said first rod has a cross-sectional area smaller than that of said valve hole.

11. The control valve according to claim 1, wherein said first rod is integrally formed with the valve body.

12. The control valve according to claim 1, wherein said second rod is integrally formed with the valve body.

13. The control valve according to claim 1, wherein said valve body has a flat end surface abutting against a peripheral area of the opening to close the valve hole.

14. The control valve according to claim 13, wherein said end surface of the valve body has a projection opposite to the valve hole.

15. The control valve according to claim 14, wherein said projection includes a tapered portion, said tapered portion having a diameter increasing toward the valve body.

16. The control valve according to claim 1, wherein said second rod urges the valve body in the second direction by the magnetic attractive force.

17. The control valve according to claim 16 further comprising means for urging the valve body in the first direction, wherein said urging means causes the valve body to fully open the valve hole when the solenoid is de-exited.

18. The variable displacement compressor having the control valve according to claim 1 further comprising:

a drive shaft for driving the cam plate; and an external driving source coupled directly to the drive shaft to rotate the drive shaft.

19. A control valve in a variable displacement compressor that adjusts the discharge displacement based on controlling of an inclination of a cam plate located in a crank chamber, wherein said compressor includes a piston operably coupled to the cam plate and located in a cylinder bore, said piston compressing gas supplied to the cylinder bore from a first area and discharging the compressed gas to a second area, the inclination of the cam plate being variable based on the pressure in the crank chamber, and a supply passage for connecting the second area with the crank chamber, wherein said control valve is placed midway on the supply passage for adjusting the amount of the gas introduced into the crank chamber from the second area through the supply passage to control the pressure in the crank chamber, said control valve comprising:

a housing having a valve hole and a valve chamber respectively disposed midway on the supply passage and a pressure chamber connected with the first area, wherein said valve hole is defined between the valve chamber and the pressure chamber, and wherein said valve hole has an opening and communicates with the valve chamber through the opening;

a valve body facing the opening and located in the valve chamber to adjust the opening size of the valve hole, said valve body being movable in a first direction and a second direction opposite to the first direction, wherein said valve body moves in the first direction to open the valve hole, and wherein said valve body moves in the second direction to close the valve hole;

a reacting member located in the pressure chamber, said reacting member reacting to the pressure in the pressure chamber;

a first rod placed between the reacting member and the valve body, said first rod having a cross-sectional area smaller than that of said valve hole, wherein said reacting member moves the valve body in the second direction via the first rod in accordance with raising of the pressure in the pressure chamber;

said housing having a guide hole defined between the pressure chamber and the valve hole to support the first rod in a slidable manner in an axial direction of the first rod, wherein said first rod extends through the guide hole and the valve hole;

a solenoid opposed to the reacting member with respect to the valve body, said solenoid having a fixed core, a plunger facing the core to move toward or away from the core, and a plunger chamber for accommodating the plunger, wherein electric current sent to the solenoid produces a magnetic attractive force between the core and the plunger in accordance with a magnitude of the current;

a second rod placed between the plunger and the valve body to urge the valve body in the second direction by the magnetic attractive force, said second rod having a cross-sectional area that is substantially equal to the cross-sectional area of said valve hole;

one of the second area and the crank chamber being connected with the valve chamber though the supply passage, the other being connected with the valve hole through the supply passage; and a passage for connecting the plunger chamber with the valve hole.

20. The control valve according to claim 19, wherein said guide hole has an opening portion and communicates with the valve hole through the opening portion, wherein said opening portion has a diameter larger than that of said first rod.

21. The control valve according to claim 20, wherein the axis of said guide hole is aligned with the axis of the valve hole, and wherein said diameter of said opening portion is substantially equal to the diameter of said valve hole.

22. The control valve according to claim 19, wherein said valve chamber is connected with the second area, and wherein said valve hole is connected with the crank chamber.

23. The control valve according to claim 19, wherein said valve chamber is connected with the crank chamber, and wherein said valve hole is connected with the second area.

24. The control valve according to claim 19, wherein said first rod and said second rod are integrally formed with the valve body.

25. The control valve according to claim 19, wherein said valve body has a flat end surface abutting against a peripheral area of the opening to close the valve hole.

26. The control valve according to claim 25, wherein said end surface of the valve body has a projection opposite to the valve hole.

27. The control valve according to claim 26, wherein said projection includes a tapered portion, said tapered portion having a diameter increasing toward the valve body.

28. The control valve according to claim 19 further comprising means for urging the valve body in the first direction, wherein said urging means causes the valve body to fully open the valve hole when the solenoid is de-exited.

29. The variable displacement compressor having the control valve according to claim 19 further comprising:

a drive shaft for driving the cam plate; and an external driving source coupled directly to the drive shaft to rotate the drive shaft.

* * * * *

UNITED STATES PATENT AND TRADEMARK OFFICE

CERTIFICATE OF CORRECTION

PATENT NO. : 5,890,876

DATED : April 6, 1999

INVENTOR(S): Ken Suitou Masahiro Kawaguchi, Hiroshi Kubo, Tomohiko Yokono, Norio Jemura, Kuzuaki Nagayoshi, Ichiro Hirata and Kouji Watanabe It is certified that error appears in the above-identified patent and that said Letters Patent is hereby corrected as shown below:

Title page, item [30]

Change "8-078780" to --8-78780--.

Title page, item [56]

Line 2, change "3-023385" to --3-23385--;

Line 3, change "6-026454" to --6-26454--;

Line 4, change "6-34685" to --6-346845--.

Signed and Sealed this

Eighth Day of February, 2000

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 5,890,876
DATED : April 6, 1999
INVENTOR(S) : Ken Suito, et al.

It is certified that error appears in the above-identified patent and that said Letters Patent is hereby corrected as shown below:

In the Title Page under the list of Inventors names, change "Ken Suito" to -- Ken Suitou--.

Signed and Sealed this

Fourteenth Day of March, 2000

*Attest:*

*Attesting Officer*

Q. TODD DICKINSON

*Commissioner of Patents and Trademarks*